United States Patent [19]

Giuffredi

[11] Patent Number: 5,002,207

[45] Date of Patent: Mar. 26, 1991

[54] PRECOMPRESSION PUMP, FOR DISPENSING LIQUID PRODUCTS FROM CONTAINERS

[75] Inventor: Giancarlo Giuffredi, Milan, Italy

[73] Assignee: Coster Technologie Speciali S.p.A., Italy

[21] Appl. No.: 432,535

[22] Filed: Nov. 7, 1989

[30] Foreign Application Priority Data

Dec. 9, 1988 [IT] Italy ..... 22906 A/88

[51] Int. Cl.[5] ..... B67D 5/42

[52] U.S. Cl. ..... 222/340; 222/385; 222/400.5

[58] Field of Search ..... 222/336, 340, 341, 321, 222/372, 378, 383, 385, 387, 400.5, 251

[56] References Cited

U.S. PATENT DOCUMENTS

| | | | |
|---|---|---|---|
| 3,248,022 | 4/1966 | Schulman et al. | 222/321 |
| 3,500,761 | 3/1970 | Clevenger et al. | 222/321 X |
| 4,053,086 | 10/1977 | DeBard | 222/341 X |
| 4,082,222 | 4/1978 | Boris | 222/385 X |
| 4,113,145 | 9/1978 | Meshberg | 222/321 X |
| 4,228,931 | 10/1980 | Ruscitti et al. | 222/321 |
| 4,532,967 | 8/1985 | Graf | 222/321 X |
| 4,856,677 | 8/1989 | Brunet et al. | 222/385 X |
| 4,960,230 | 10/1990 | Marelli | 222/321 |

*Primary Examiner*—Michael S. Huppert
*Assistant Examiner*—Kenneth R. DeRosa
*Attorney, Agent, or Firm*—Steinberg & Raskin

[57] ABSTRACT

The improved precompression pump has a body in which a hollow stem is slidingly disposed under the control of a knob or pushbutton provided with a nozzle. On the stem there is mounted a piston arranged to move along the stem against the action of a spring to uncover ports through the stem which communicate with the cavity in the stem. A non-return (intake) valve is positioned between the piston and a dip tube which is immersed in the product to be dispensed. The spring has a portion which is substantially cylindrical and another portion which is substantially conical, and moreover is not in contact with the product. The spring is secured at an intermediate point to the stem, acts at one end against the piston and is secured at its other end to the body.

7 Claims, 2 Drawing Sheets

PRECOMPRESSION PUMP, FOR DISPENSING LIQUID PRODUCTS FROM CONTAINERS

BACKGROUND OF THE INVENTION

This invention relates to a precompression pump, particularly for the atomized dispensing of products in liquid or similar form from a container, of the type comprising a body, an at least partly hollow stem mobile within said body against the action of a return spring, a piston mounted mobile on the stem against the action of elastic means so as to open a passage towards the cavity in the stem, the piston defining with the body a suction and metering chamber, and an intake valve means for the access of said liquid to said chamber.

Precompression pumps are pumps of the type which allow the product to be dispensed only when a pressure lying between predetermined limits acts on it. Precompression pumps of the indicated type are known for example from U.S. Pat. Nos. 3,463,093 (see FIG. 2) and 4,113,145 (see FIG. 27).

In known pumps of this type, the return spring is situated in the suction and metering chamber, so that it is in contact with the liquid to be dispensed. Because of this, the spring even if made of stainless steel can contaminate the product by transferring to it any substances, such as lubricants, which were used during the operations involved in its manufacture, such as the extrusion of the wire from which the spring is formed and the subsequent winding of the spring, and have remained on it. This is unacceptable when the product to be dispensed is a pharmaceutical or cosmetics product. In addition, the spring located in the suction and metering chamber considerably increases the clearance volume of the pump.

SUMMARY OF THE INVENTION

An object of the invention is to remedy the aforesaid drawbacks by removing the return spring from contact with the liquid to be dispensed.

This and further objects which will be more apparent from the detailed description given hereinafter are attained according to the invention by an improved pump of the indicated type, which is characterized essentially in that the return spring operates under tension and is situated at the opposite end of the piston to that at which the suction and metering chamber is situated.

To allow considerable automation of pump assembly and to reduce the number of components, according to an important characteristic of the invention the return spring and the elastic means acting on the piston are one and the same spring, a first part of which acts as the return spring and the second part of which loads the piston.

According to an advantageous embodiment of the invention, the purpose of which is to allow the single spring to be adequately secured to the pump body, its first part is of frusto-conical shape and its second part is of cylindrical shape.

According to an important characteristic of the invention, the single spring is secured at an intermediate point thereof to the stem.

In the pump of the invention the conical part of the spring acts under tension and returns the stem and thus the piston into its rest position, whereas the cylindrical part acts by compression and exercises a preload on the piston, which also performs the delivery valve function.

A further advantage of the improved pump of the invention is that it can also operate by withdrawing liquid from a container, such as a canister under slight overpressure.

BRIEF DESCRIPTION OF THE DRAWINGS

The invention will be more apparent from the detailed description of preferred embodiments thereof given hereinafter by way of non-limiting example with reference to the accompanying drawing in which.

PREFERRED EMBODIMENTS OF THE INVENTION

Figure 1:
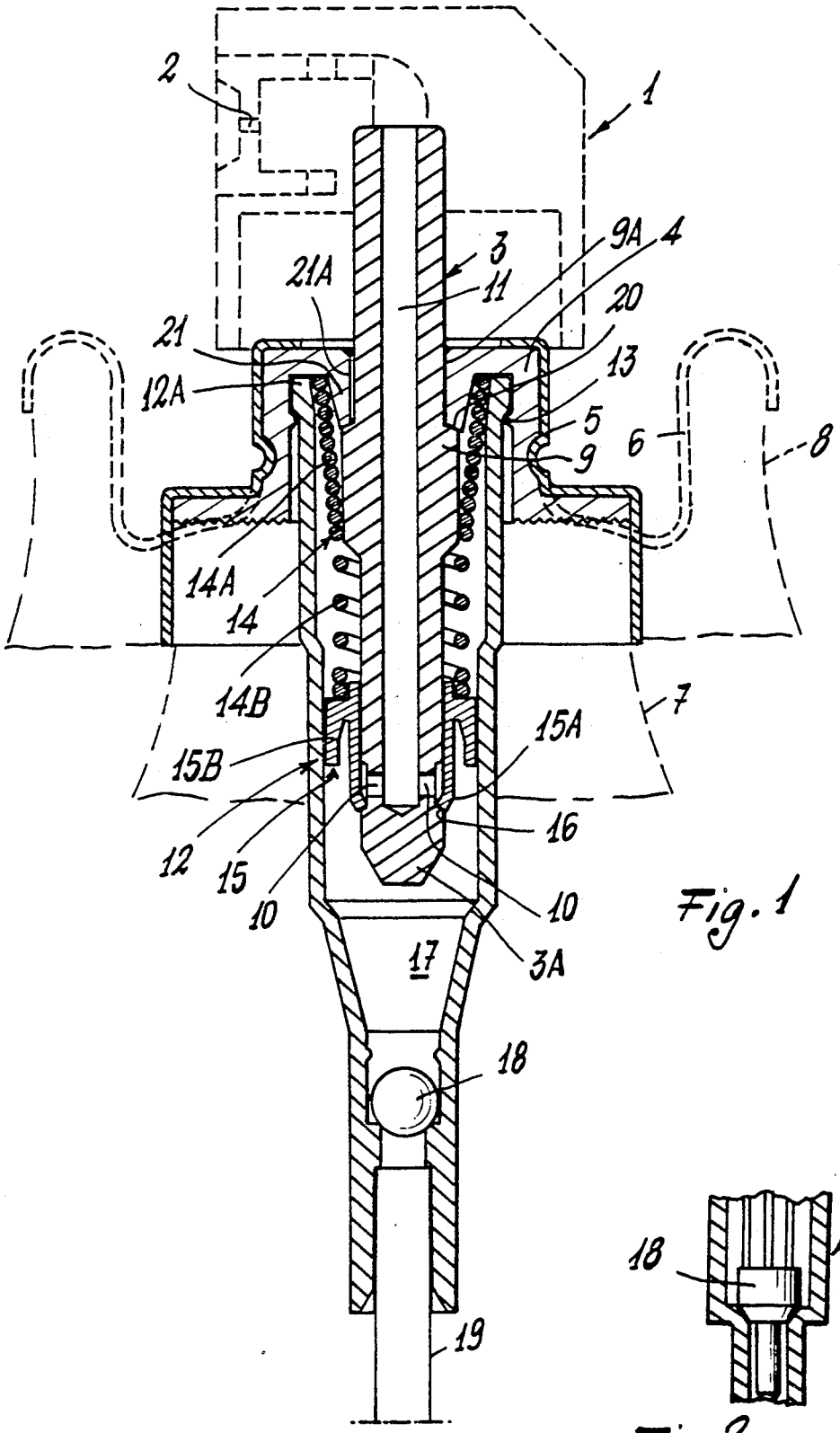
FIG. 1 is a longitudinal section through the improved pump according to the invention.

In FIG. 1, the reference numeral 1 indicates a conventional dispensing knob provided with a pulverization or atomization nozzle 2. The knob 1 is conventionally connected to a stem 3 a part of which is axially hollow, namely at that end which projects from a gasket 4 which seals against the stem and is enclosed within a cap 5 or cup 6 of conventional type.

The cap 5, preferably of the screwed type, enables the pump to be connected to a suitable vessel or bottle 7, whereas the cup 6 enables it to be connected to a canister 8 or other similar container.

In an intermediate position the stem 3 comprises an annular enlargement 9 and in proximity to its other end is provided with radial ports 10 which communicate with the dead-bottomed axial cavity 11 of the stem 3.

The stem 3 is slidingly guided through the gasket 4 and is arranged to move axially within a hollow plastics body 12 which forms the pump body and which at its internally conical upper end 12A is clamped in the gasket 4 by cooperation between a flange surrounding said end 12A and an inner annular shoulder 13 of the gasket itself.

Between the gasket 4 and the conical interior of the end 12A of the body 12 there is held the end of a conical part 14A of a one-piece spring 14. The other end of the conical part 14A grips the annular enlargement 9 of the stem 3 so that it moves axially with the stem.

The spring 14 also comprises a cylindrical part 14B which acts on a piston 15 mounted to be slidable on the stem 3 towards and away from an annular stop ledge 16 provided on the stem 3 at its ports 10. The conical end 15A of the piston 15 halts against the ledge 16 to thus black these ports when the pump is in its rest position.

The piston 15, constructed of elastically deformable plastics material, is provided on its outer periphery with an annular seal flange 15B. This flange seals against the body 12.

Figure 2:
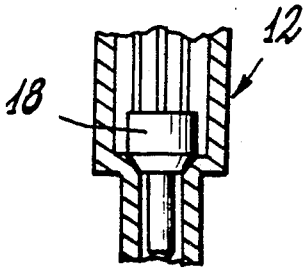
FIG. 2 is a longitudinal section through a detail of a different intake valve.

The piston 15 together with the inner end 3A of the stem 3 represents the mobile wall of a suction and metering chamber 17 which is bounded by the rest of the body 12 and by an intake valve 18 which can be a ball valve (as in FIG. 1) or a cylindrical or mushroom shaped member (as in FIG. 2).

A dip tube 19 is conventionally connected to the body 12 upstream of the non-return valve.

The pump operation is as follows:

The initial position (pump inoperative) is that shown in FIG. 1. It is assumed that the chamber 17 is full of liquid. On pressing the knob 1, the liquid contained in the chamber 17 is subjected to pressure. When a given pressure is reached such as to overcome the opposing action of the part 14B of the spring 14, the piston 15 moves to uncover the ports 10 so that the liquid enters the stem 3 and flows in atomized form from the nozzle 2.

The pressure which acts on the decreasing volume of liquid corresponds to the load which the part 14B of the spring has to exert to keep the communication between the chamber 17 and ports 10 open. As the liquid volume decreases the piston 12 and stem 3 move lower. The lowering of the stem 3 results in the extension of the conical part 14A of the spring 14.

When the travel stroke is terminated and the knob 1 is released, the cylindrical part 14B of the spring 14 moves the piston 15 so that it closes the ports 10, while the conical part 15A returns the stem 3 and piston 15 into their initial positions. The effect of this movement is that the intake valve 18 opens and new liquid is drawn into the variable volume chamber 17 through the dip tube 19. The movement stops when the conically shaped outer rim 20 presses tightly against a suitably shaped inner annular lip of the gasket 4 to prohibit passage of air into the pump, such passage however being allowed during the travel of the stem 3 by virtue for example of a small axial groove 21A provided in the wall of the hole 4A through the gasket 4, this being the hole through which the stem 3 passes. The groove is closed by the edge 20 of the enlargement 9 when in the position shown in FIG. 1.

Figure 3:
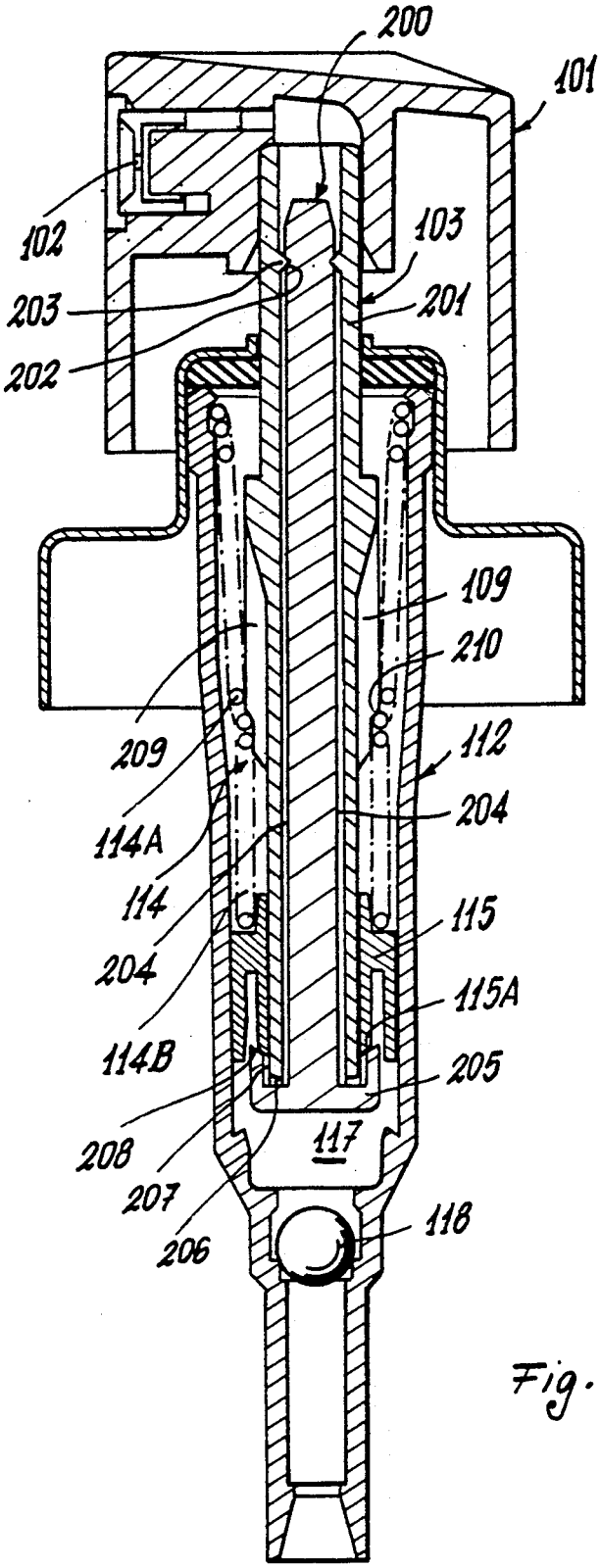
FIG. 3 is a longitudinal section through a different embodiment of the invention.

A different embodiment of the pump according to the invention is shown in FIG. 3, in which parts equal or corresponding to those of the embodiment show in FIG. 1 are indicated by the same reference numerals plus 100.

In this embodiment the stem 103 is formed from two parts 200, 201, engaged one within the other to define between them a passage for the liquid to be dispensed. More specifically, for the engagement between these two parts, the inner part 200 comprises at one end an annular groove 202 into which penetrate annularly distributed teeth 203 projecting from the other outer part 201 of the stem 103. The engagement is enabled by the deformability of the plastics materials from which these parts are formed.

The liquid is able to pass along the stem because the inner part 200 comprises, along a portion thereof, a series of peripherally distributed axial ribs 204 which center the two parts 200, 201 and keep them spaced apart.

The inner part 200 of the stem comprises at its other end a head 205 of inverted T cross-section which presses against the corresponding end of the outer part 201 of the stem 103. To allow the liquid to pass, the end of the part 201 comprises a series of radial grooves 206 and the head 205 comprises on its inside a series of axial grooves 207.

The head 205 acts as a stop for the piston 115 when this interrupts the passage of liquid towards the stem 103. In this position the inner edge 115A of the piston 115 presses against the frusto-conical periphery 208 of the head.

The pump operation corresponds to that of the previously described embodiment.

Where used herein, the term "liquid" includes suspensions, solutions, emulsions and the like.

What I claim is:

1. An improved precompression pump, particularly for dispensing products in liquid or similar form, comprising a body, an at least partly hollow stem slidingly disposed within said body, said stem having passageways forming an inlet to said hollow portion, a piston slidingly mounted on the stem, an elastic means biasing said piston to close said passageways, said piston defining with the body a suction and metering chamber, and wherein a return spring operates under tension and is disposed on a side of said piston opposite to said suction and metering chamber.

2. A pump as claimed in claim 1, wherein the stem is formed from two connected parts, one inside the other, to define between them a passage for the liquid, the inner part having a head which projects outwards of the outer part to act as a stop for the piston.

3. A pump as claimed in claim 1, wherein the return spring and the elastic means acting on the piston are one and the same spring, a first part of which acts as the return spring and the second part of which loads the piston.

4. A pump as claimed in claim 3 wherein the first part is of frusto-conical shape.

5. A pump as claimed in claim 3 wherein the second part acting on the piston is substantially cylindrical.

6. A pump as claimed in claim 3, wherein the first part is of frusto-conical shape and the second part is of cylindrical shape.

7. A pump as claimed in claim 6, wherein the one spring in is secured at an intermediate point thereof to the stem.

* * * * *